US005933908A

United States Patent [19]

O'Brien

[11] Patent Number: 5,933,908

[45] Date of Patent: Aug. 10, 1999

[54] HONEYCOMB BRISTLES WITH RADIATING SPOKES AND APPLICATOR BRUSHES EMPLOYING SAID BRISTLES

[75] Inventor: Timothy D. O'Brien, Crofton, Md.

[73] Assignee: Specialty Filaments, Inc., Odenton, Md.

[21] Appl. No.: 08/944,993

[22] Filed: Oct. 7, 1997

[51] Int. Cl.[6] ..... A46B 11/00

[52] U.S. Cl. ..... 15/207.2; 428/397; 428/398

[58] Field of Search ..... 15/207.2, DIG. 6, 15/159.1; 428/398, 397

[56] References Cited

U.S. PATENT DOCUMENTS

| | | | |
|---|---|---|---|
| 3,095,258 | 6/1963 | Scott . | |
| 3,745,061 | 7/1973 | Champaneria et al. | 428/398 |
| 4,307,478 | 12/1981 | Ward et al. | 15/159.1 |
| 5,128,208 | 7/1992 | Bond et al. | 428/397 |
| 5,141,811 | 8/1992 | Kawakami et al. | 428/364 |
| 5,701,629 | 12/1997 | O'Brien . | |
| 5,786,087 | 7/1998 | Cansler | 15/207.2 |

FOREIGN PATENT DOCUMENTS

| | | |
|---|---|---|
| 59-36714 | 2/1984 | Japan . |

*Primary Examiner*—Robert Warden
*Assistant Examiner*—Kaj K. Olsen
*Attorney, Agent, or Firm*—Caesar, Rivise, Bernstein, Cohen & Pokotilow, Ltd.

[57] ABSTRACT

Level (i.e., uniform diameter along the length thereof) and tapered (varying diameter along the length thereof) brush bristles include a central core having an outer wall and a pair of internal, semi-cylindrical passages separated by a central dividing wall. A plurality of spokes, or ribs, extend radially outwardly from the outer wall of the central core in planes other than the plane of the central dividing wall and also are spaced equidistant from each other about the circumference of the outer wall. Applicator brushes employing the aforementioned bristles also form a part of this invention.

6 Claims, 4 Drawing Sheets

HONEYCOMB BRISTLES WITH RADIATING SPOKES AND APPLICATOR BRUSHES EMPLOYING SAID BRISTLES

FIELD OF THE INVENTION

This invention relates generally to thermoplastic bristles, and more particularly to thermoplastic bristles suitable for use in applicator brushes, e.g., paintbrushes, cosmetic brushes, toothbrushes, and the like, and to applicator brushes employing such bristles, especially paintbrushes.

BACKGROUND OF THE INVENTION

Thermoplastic bristles that are both solid and hollow have been employed in applicator brushes, such as paintbrushes. Moreover, hollow bristles having a single central passage with radiating spokes, as well as honeycomb bristles having two semi-cylindrical passages without radiating spokes have been employed in applicator brushes. All of these prior art structures have one or more deficiencies that are overcome by the present invention.

Solid bristles, although being sufficiently durable for use in commercial brushes, do have certain drawbacks relative to hollow bristles for applicator brushes. In particular, solid bristles are harder to flag than hollow bristles, and, do to their higher bulk density than void-containing bristles (e.g., hollow bristles and honeycomb bristles) such solid bristles provide lower yields in the manufacture of applicator brushes, i.e., the bristle weight per brush is higher when solid bristles are used than when void-containing bristles are employed. Although hollow bristles having a single central passage, both with and without radiating spokes, and honeycomb bristles having a pair of internal semi-cylindrical passages separated by a dividing wall can be made with less polymer than solid bristles, and therefore provide higher yields in the manufacture of applicator brushes than employing solid bristles, they have other deficiencies. In particular, hollow bristles having a single central passage are often weaker than desired, and also tend to receive paint (or other viscous liquid to be applied) deep into the interior of the passage, thereby making it difficult to effectively clean brushes employing such bristles. Moreover, such hollow bristles have limited polymer surface area for flagging to enhance the evenness of application of paint or other viscous fluids. Although adding radiating spokes to the hollow bristles does increase the surface area of polymer that can be flagged, such bristles still tend to be weaker than desired, and still are susceptible of receiving paint or other viscous liquids excessively deep into the interior of the cylindrical opening.

Honeycomb bristles, by virtue of having a central polymer wall dividing the two semi-cylindrical passages, do tend to have increased strength relative to hollow bristles. In addition the central wall constitutes an additional polymer surface that can be flagged to enhance the evenness of distribution of high viscosity fluids, such as paint. Moreover, by including a central wall dividing the central passage into two semi-cylindrical passages, each of such passages is less than one-half the area of a single cylindrical passage in a hollow bristle of the same diameter as the honeycomb bristle. These more restricted passages are less likely to receive high viscosity fluids, such as paint, undesirably deep into the interior thereof to impair the cleaning efficiency of brushes employing such bristles.

In spite of the positive attributes of a variety of the bristles identified above, a need still exists for new bristle constructions having relatively high yields in the manufacture of applicator brushes, and that have improved performance characteristics, thereby making them well-suited for use primarily for consumer (as opposed to professional) brush applications. It is to such bristles and applicator brushes employing such bristles that the present invention relates.

OBJECTS OF THE INVENTION

It is a general object of this invention to provide improved synthetic, thermoplastic brush bristles for applicator brushes, especially paintbrush bristles.

It is a general object of this invention to provide improved applicator brushes, especially paintbrushes.

It is a further object of this invention to provide improved synthetic, thermoplastic brush bristles that provide a high yield in the manufacture of applicator brushes.

It is a further object of this invention to provide improved synthetic, thermoplastic brush bristles that are easy to flag and, when used in applicator brushes of this invention, especially paintbrushes, provide a highly uniform distribution of the material being applied.

SUMMARY OF THE INVENTION

The above and other objects of this invention are achieved with synthetic, thermoplastic brush bristles and applicator brushes employing same, wherein the brush bristles are either level (i.e., uniform diameter along the length thereof) or tapered (varying diameter along the length thereof) and include a central core having an outer wall and a pair of internal, semi-cylindrical passages separated by a central dividing wall and also include a plurality of spokes, or ribs, extending radially outwardly from the outer wall of the central core in planes other than the plane of the central dividing wall.

Most preferably the radiating ribs also are spaced equidistant from each other about the outer wall of the central core of the bristle to provide a uniform weight distribution about the circumference. This uniformity in weight distribution tends to maintain the bristle substantially straight in use, i.e., camber or curl in the longitudinal, or elongate direction of the bristle is avoided or greatly minimized.

BRIEF DESCRIPTION OF THE DRAWINGS

The above and other objects and many attendant features of this invention will become readily appreciated as the same becomes better understood by reference to the following detailed description when considered in connection with the accompanying drawings wherein.

DESCRIPTION OF THE BEST MODE OF THE INVENTION

Reference throughout this application to "applicating end" means the end of a bristle or brush from which paint, powder or other material flows onto a surface when applying such paint, powder, or other material with the brush.

Reference throughout this application to "ferrule end" means the end of a bristle or brush opposite, or distal the applicating end, at which the bristles are bundled or attached to a handle or other brush-manipulating structure.

Reference throughout this application to "flagged" means having applicating ends frayed, split, or lengthwise separated.

Figure 3:
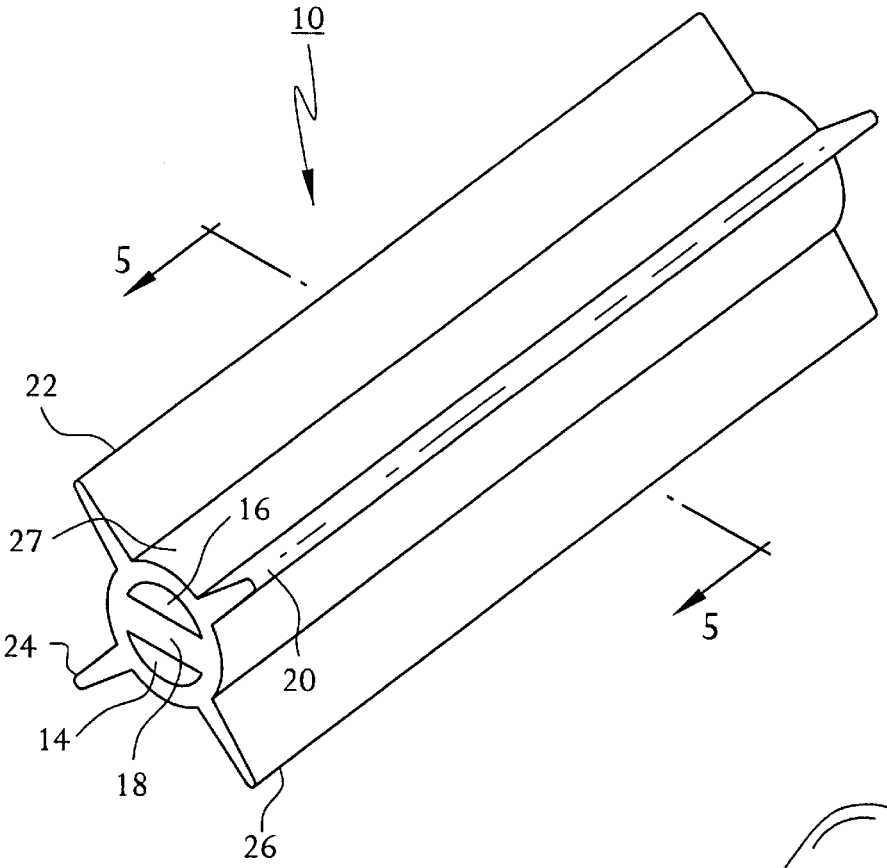
FIG. 3 is an idealized, isometric view of a level bristle in accordance with this invention.
Figure 4:
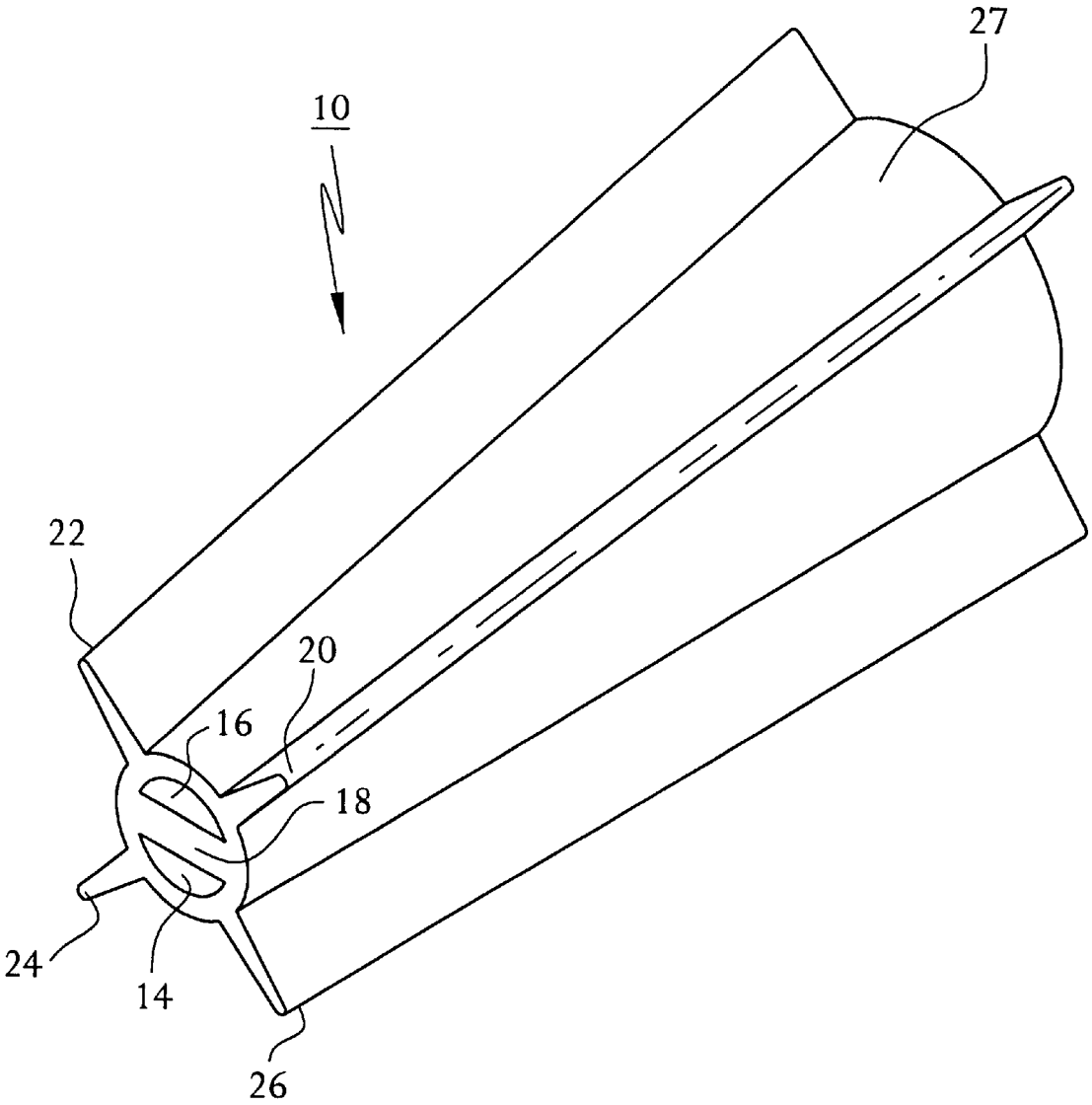
FIG. 4 is an idealized, isometric view of a tapered bristle in accordance with this invention.

Referring now in greater detail to the various figures of the drawing wherein like reference characters refer to like parts, a bristle in accordance with the present invention is shown generally at 10 in FIGS. 1 and 3–5. The bristle 10 either can be level as shown in FIG. 3 or tapered as shown in FIG. 4, and preferably is extruded from a thermoplastic polymer, e.g., polyester, nylon, etc.

The bristle 10 includes a central core 12 having a pair of semi-cylindrical passages 14 and 16 extending the length of the bristle and separated by a central dividing wall 18. In addition, the bristle 10 includes four spokes, or ribs, 20, 22, 24 and 26 projecting radially from the outer surface 27 of said core.

Figure 5:
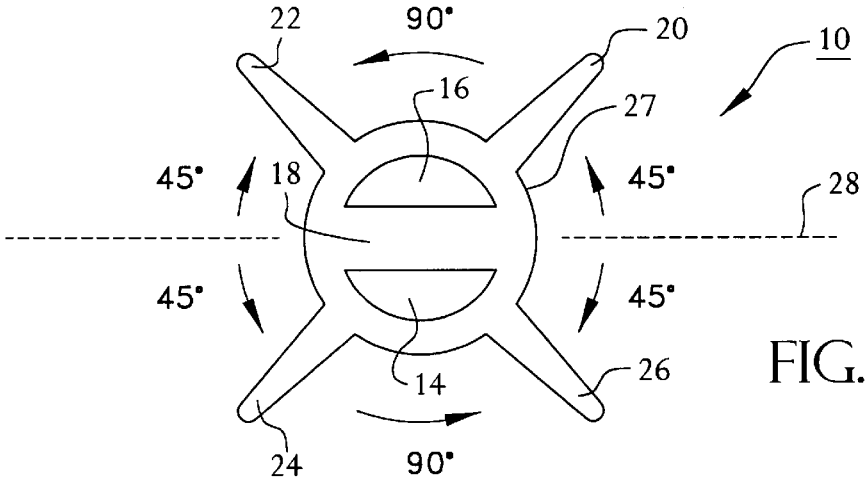
FIG. 5 is a sectional view taken along line 5—5 of FIG. 3.

Still referring to FIGS. 1 and 3–5, in a preferred embodiment of this invention the spokes 20, 22, 24 and 26 are equi-spaced from each other around the circumference of the central core 12 of the bristle 10. In other words, each spoke is spaced from its adjacent spoke through an angle of 90° and from a central axis 28 passing through the dividing wall 18 through an angel of 45° (FIG. 5).

It is an extremely important feature of this invention that the spokes be equally spaced about the circumference of the bristle, that none of the spokes be in the same plane as the central dividing wall 18, and that the spokes adjacent to, and on opposite sides of the dividing wall 18 be equally spaced from the central axis 28 of said dividing wall. This structural arrangement among the central dividing wall 18 and the spokes provides for a balanced weight distribution around the circumference of the bristle, which assists in maintaining the bristle substantially straight throughout the longitudinal extent thereof, i.e., avoids camber or curl in the longitudinal direction of the bristle 10. This is a very important property of bristles employed in applicator brushes, such as in paintbrushes, toothbrushes and cosmetic brushes.

Figure 1:
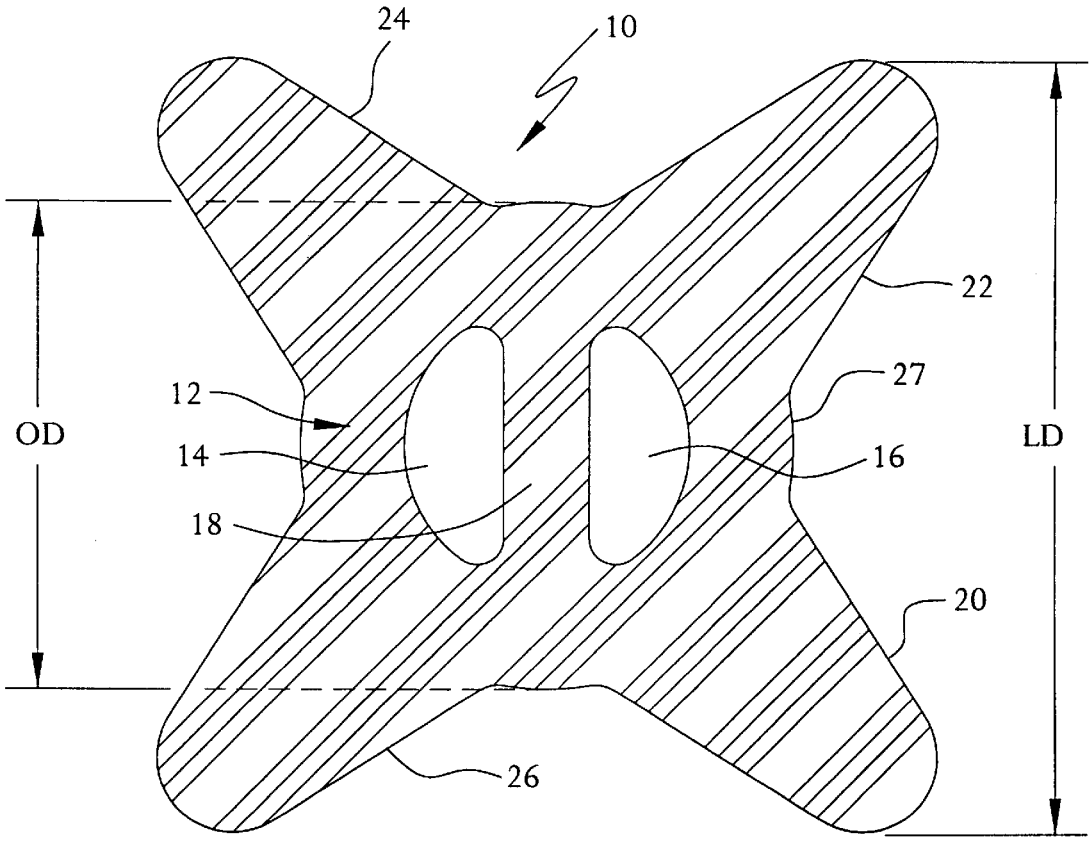
FIG. 1 is cross-sectional view of a bristle in accordance with this invention.
Figure 2:
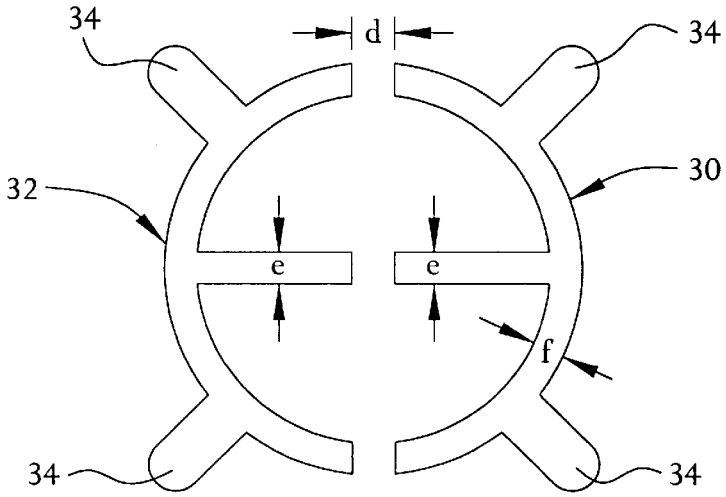
FIG. 2 is an elevational view of the configuration of the passages in an extruder die for forming the bristle illustrated in FIG. 1.

Referring to FIG. 2, the configuration of a die orifice in an extrusion die plate for forming the bristle 10 illustrated in FIG. 1 is shown. Specifically, the die plate includes a pair of generally E-shaped passages 30, 32 that face each other and are spaced apart by a gap d of approximately 3 mils. Polymer extruded through the passages 30, 32 join together across the gap to define the central core 12 having the pair of semi-cylindrical passages 14 and 16 separated by the central dividing wall 18.

The transverse dimension e of the central branch of each of the passages 30, 32, through which polymer is extruded to form the central dividing wall 18, is approximately 6 mils, and the transverse dimension f of the remaining branches of each passage 30, 32 is approximately 5 mils. Elongate orifices 34 project radially outward from the upper and lower arm sections of each of the generally E-shaped passages 30 and 32. Polymer is extruded through these latter passages to form the projecting ribs 20, 22, 24 and 26. Each of the elongate orifices 34 has a radial length l of approximately 15 mils and a transverse dimension t of approximately 4 mils.

Figure 6:
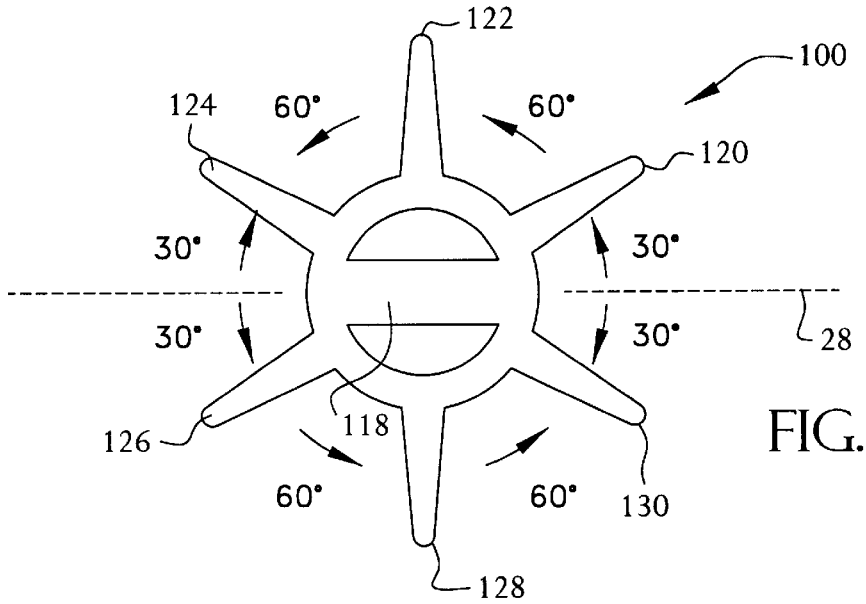
FIG. 6 is a sectional view similar to FIG. 5, but showing another embodiment in accordance with this invention.

Referring to FIG. 6, a bristle 100 including six radiating spokes 120, 122, 124, 126, 128 and 130 is illustrated. As in the bristle 10, the spokes in the bristle 100 are equi-spaced from each other around the circumference of the core of said bristle. Specifically, each spoke is spaced from its adjacent spoke through an angle of 60° and the spokes adjacent to the central axis 28 of the dividing wall 118 are spaced from said central axis through an angle of 30°.

Figure 7:
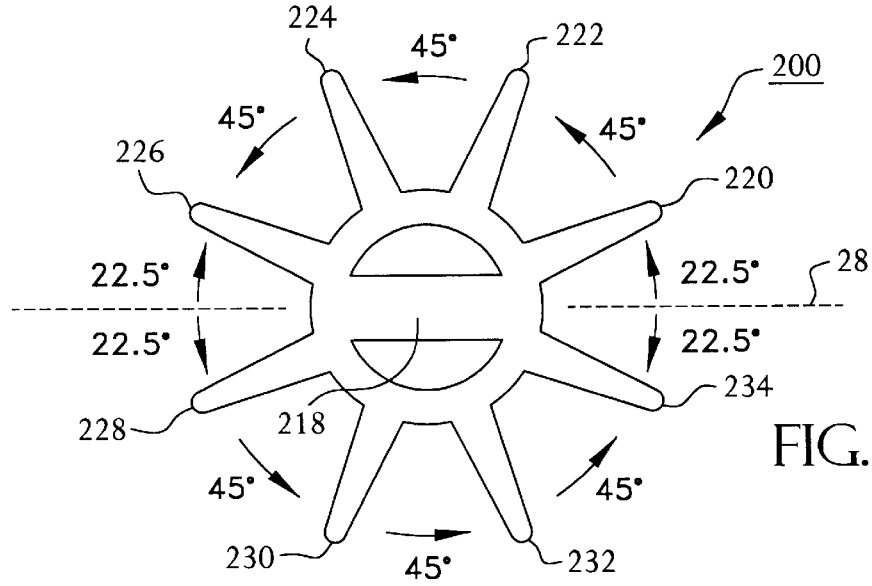
FIG. 7 is a sectional view similar to FIG. 5, but showing still another embodiment of this invention.

As in the bristle 10, none of the spokes in the bristle 100 are in the same plane as the central dividing wall 118, and the spokes adjacent to, and on opposite sides of the dividing wall 118 are equally spaced from the central axis 28 of said dividing wall. As in the bristle 10, this structural arrangement among the central dividing wall 118 and the spokes 120, 122, 124, 126, 128 and 130 in the bristle 100 provides for a balanced weight distribution around the circumference of the bristle, which assists in maintaining the bristle substantially straight throughout the longitudinal extent thereof, i.e., avoids camber or curl in the longitudinal direction of the bristle 10. Referring to FIG. 7, a bristle 200 in accordance with this invention, including eight radiating spokes 220, 222, 224, 226, 228, 230, 232 and 234, is illustrated. As in the bristles 10 and 100, the spokes in the bristle 200 are equi-spaced from each other around the circumference of said bristle. Specifically, each spoke is spaced from its adjacent spoke through an angle of 45° and the spokes adjacent the central axis 28 passing through dividing wall 218 are spaced from said central axis through an angle of 22.5°.

As in the bristle 10, none of the spokes in the bristle 200 are in the same plane as the central dividing wall 218, and the spokes adjacent to, and on opposite sides of the dividing wall 218 are equally spaced from the central axis 28 of said dividing wall. Also as in the bristles 10 and 100, this structural arrangement among the central dividing wall 218 and the spokes 220, 222, 224, 226, 228, 230, 232 and 234 in the bristle 200 provides for a balanced weight distribution around the circumference of the bristle, which assists in maintaining the bristle substantially straight throughout the longitudinal extent thereof, i.e., avoids camber or curl in the longitudinal direction of the bristle 10.

The diameter of the central core of the bristles of this invention can be varied, depending upon the specific application of such bristles. For example, in applicator brushes in the nature of cosmetic brushes employing level bristles, such bristles generally have a central core with an outside diameter in the range of 2.5 mils to 7 mils. For paintbrush applications, such level bristles generally have a central core with an outside diameter in the range of 7 to 15 mils.

Referring to FIG. 1, typical dimensions of a paintbrush bristle of the type illustrated in FIG. 1 are: (1) 8 mil outside diameter OD central core 12 (level bristle); (2) 13 mil linear dimension LD between the distal ends of adjacent spokes, e.g., 22 and 24. Moreover, each of the spokes 20, 22, 24 and 26 is tapered and terminates in a rounded end. The transverse dimension defined between tapered side walls at the base of each of the spokes is approximately 4 mils, and the transverse dimension defined between tapered side walls at the distal end of each of the spokes (but below the rounded end thereof) is approximately 3 mils.

In a tapered paintbrush bristle of the type illustrated in FIG. 4, the outside diameter of the central core at the tip portion, i.e., the applicating end, should be no less than about 4 mils and the outside diameter of the central core at the butt portion, i.e., the ferrule end secured to the ferrule of a paint-brush handle, should be no greater than about 20 mils.

The number of radiating spokes also can be varied, depending upon a variety of factors, including the diameter of the central core and the viscosity of the material to be applied by a brush employing such bristles. Specifically, if the spokes are too close together some viscous materials either may not be adequately held between the spokes, or, if initially held, may not be easy to clean off of the bristles.

The length of the individual bristles can be varied depending upon the end use application. In paintbrush applications the length of the bristles usually varies in the range of from about one inch to about six inches, depending on the desired length of the bristle portion of the resultant paintbrush.

Most preferably, the relationship between the dimensions of the central core and the length of the spokes is as set forth in co-pending application Ser. No. 08/504,114, now U.S. Pat. No. 5,701,629, titled "Hollow Brush Bristle with Radiating Spokes"; identifying Timothy D. O'Brien as the inventor. The entire subject matter of this latter application is incorporated by reference herein.

The dimension in the bristles 10, 100 and 200 of this invention corresponding to the dimension of the inner diameter of the hollow central core in the bristles forming the subject matter of the '114 application, for purposes of establishing the length of the spokes in the bristles of this invention, is the maximum linear dimension r between inner surfaces of the adjacent semi-cylindrical passages 14, 16, extending perpendicularly through the central dividing wall 18, 118 and 218 (see FIGS. 5–7).

Most preferably, the dimensions of the central core of the bristles of this invention are the same as in the honeycomb bristles described in co-pending application Ser. No. 08/392,228, now U.S. Pat. No. 5,786,087 filed on Feb. 22, 1995 in the name of Ronald B. Cansler. The entire subject matter of this latter application is incorporated by reference herein.

Figure 8:
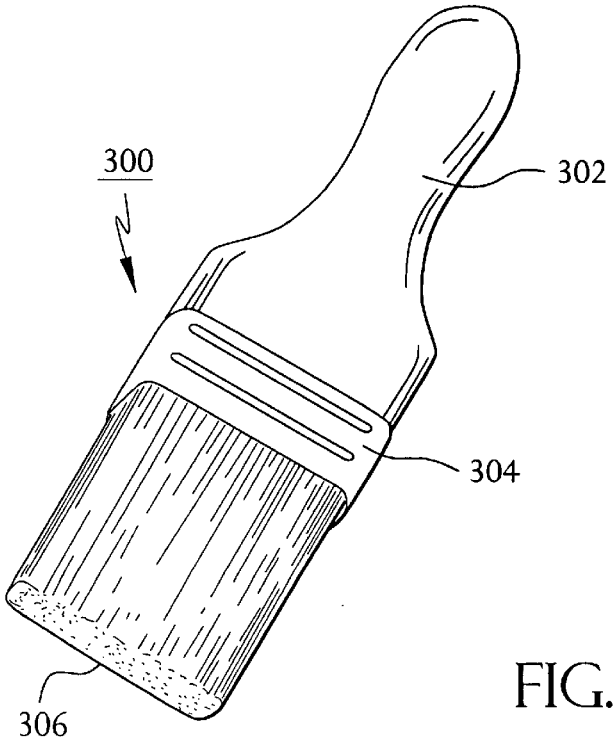
FIG. 8 is an isometric view of an exemplary embodiment of an applicator brush of this invention in the form of a paintbrush employing bristles of this invention.

Referring to FIG. 8, an applicator brush of this invention, in the form of a paintbrush is shown at 300. The paintbrush 300, except for the construction/arrangement of bristles, is of a conventional construction. A plurality of the bristles of this invention are shown bundled and attached to a handle 302 that includes a ferrule 304. The ferrule ends of the bundle of bristles are fastened within the ferrule 304 in a conventional manner that is well known in the art. The bundle of bristles have an applicating end 306 that is distal the handle 302. It should be understood that the brush 300 is shown by way of example, and the numerous other brush constructions may be employed within the broadest aspects of this invention. For example, the ferrule 304 may be omitted or replaced by other means for holding the bristles in a bundle, and, the handle 302 may be replaced by some other brush manipulator, such as a roller, robot arm, holder core, etc.

It also should be understood that the bristle bundles employed in the applicator brushes of this invention may include a combination of bristles within the scope of this invention and other, conventional bristles, e.g., other synthetic, thermoplastic bristles, natural (e.g., animal) bristles, etc. Although 100% of the bristles of this invention preferably are employed in the applicator brushes, e.g., paintbrush 300, improved applicator brushes of this invention may include as little as 5% by weight; more preferably at least 10% by weight and most preferably at least 15% by weight of such bristles in combination with other, e.g., conventional, bristles.

The bristles of this invention have a number of advantages over prior art hollow and honeycomb bristles.

First, the inclusion of the central dividing wall 18, 118 and 218 in the bristles 10, 100 and 200 of this invention renders the bristles more stable than hollow bristles having a single, central passage through them. Second, the provision of the central dividing wall provides an additional surface to be flagged as compared to a bristle with a single central passage, for the purpose of enhancing the evenness of paint application. Third, the inclusion of radiating ribs or spokes in the honeycomb construction also increases the surface available for flagging as compared to a bristle with a single central passage (with or without ribs) or to a honeycomb bristle without ribs.

The aforementioned benefits are achieved in bristles of this invention that tend to remain straight during use, i.e., they do not tend to develop camber or curl because of the unique and effective weight distribution of the polymer within the bristles.

Without further elaboration, the foregoing will so fully illustrate my invention that others may, by applying current or future knowledge, adopt the same for use under various conditions of service.

What is claimed as the invention is:

1. An applicator brush comprising:

a plurality of brush bristles formed of a thermoplastic polymer, each of said bristles having an elongate dimension terminating at opposed ferrule and applicating ends;

means for holding the plurality of brush bristles in a bundle at the ferrule ends;

at least 5% by weight of the plurality of bristles including a central core having an outer wall and a pair of internal, semi-cylindrical passages extending along the elongate dimension and being separated by a central dividing wall, further including a plurality of spokes extending radially outwardly from the outer wall of the central core in planes other than the plane of the central dividing wall.

2. The applicator brush of claim 1, wherein 100% by weight of the plurality of bristles includes a central core having an outer wall and a pair of internal, semi-cylindrical passages extending along the elongate dimension and being separated by a central dividing wall, said bristles further including a plurality of spokes extending radially outwardly from the outer wall of the central core in planes other than the plane of the central dividing wall.

3. The applicator brush of claim 1, wherein said spokes are spaced equidistant from each other about the outer wall of said core.

4. The applicator brush of claim 1, wherein said at least 5% by weight of the plurality of bristles being of a substantially uniform transverse cross-sectional dimension along said elongate dimension.

5. The applicator brush of claim 1, wherein said at least 5% by weight of the plurality of bristles being of a tapered configuration having a greater cross-sectional dimension at the ferrule end than at the applicating end.

6. The applicator brush of claim 1, wherein said at least 5% by weight of the plurality of bristles include at least four radiating spokes.

* * * * *